US005113170A

United States Patent [19]

Goessler et al.

[11] Patent Number: 5,113,170

[45] Date of Patent: May 12, 1992

[54] TEMPERATURE SWITCH

[75] Inventors: Gerhard Goessler, Oberderdingen; Eugen Wilde, Knittlingen, both of Fed. Rep. of Germany

[73] Assignee: E.G.O. Elektro-Gerate Blanc u. Fischer, Fed. Rep. of Germany

[21] Appl. No.: 578,354

[22] Filed: Sep. 6, 1990

[30] Foreign Application Priority Data

Sep. 8, 1989 [DE] Fed. Rep. of Germany ..... 3929965

[51] Int. Cl.[5] ..... H01H 37/48

[52] U.S. Cl. ..... 337/394; 337/123; 337/382; 219/449

[58] Field of Search ..... 219/449, 512; 337/394, 337/393, 382, 123

[56] References Cited

FOREIGN PATENT DOCUMENTS 116861 1/1984 European Pat. Off. .
0150087 1/1985 European Pat. Off. .
0348716 1/1990 European Pat. Off. .
735491 5/1943 Fed. Rep. of Germany .
7826549 9/1978 Fed. Rep. of Germany .
2839161 3/1980 Fed. Rep. of Germany .
2500586 11/1987 Fed. Rep. of Germany .
3821496 12/1989 Fed. Rep. of Germany .
2435796 4/1980 France .
2069300 8/1981 United Kingdom .
2146431 4/1985 United Kingdom .
2172749 9/1986 United Kingdom .

*Primary Examiner*—Harold Broome
*Attorney, Agent, or Firm*—Eckert Seamans Cherin & Mellott

[57] ABSTRACT

A temperature switch for limiting the temperature of a glass ceramic plate against the radiation emanating from light and dark radiators has a sensor, which comprises a metallic sensor tube and an inner ceramic rod. Over the sensor is drawn a steatite tube, which on the one hand ensures the electrical insulation between the heaters and the glass ceramic plate and on the other so shields the radiation by reflection, absorption and thermal mass, that the sensor is given a temporary response delay and a greater switching hysteresis.

20 Claims, 1 Drawing Sheet

FIG. 1
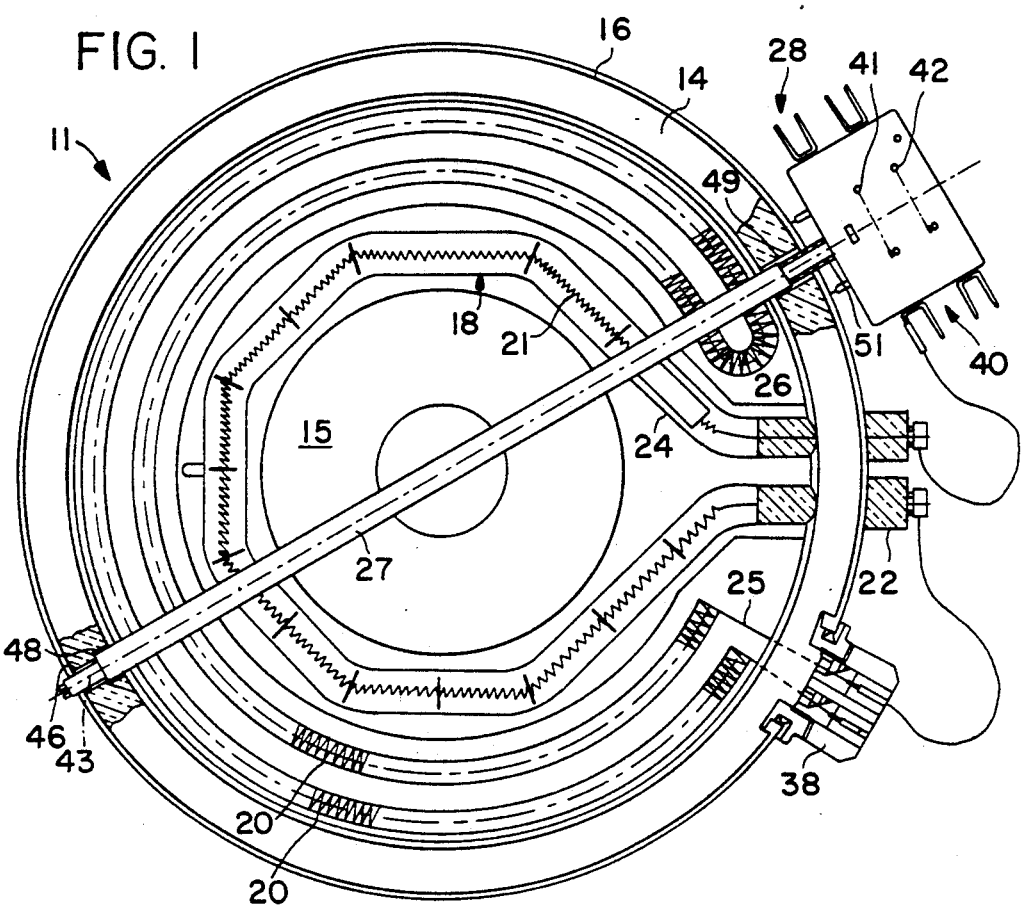
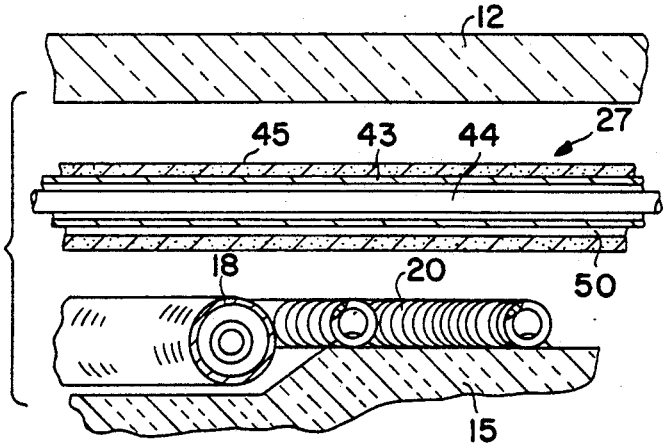
FIG. 2
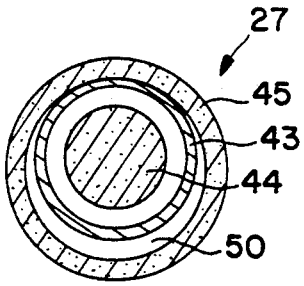
FIG. 3

TEMPERATURE SWITCH

BACKGROUND OF THE INVENTION

The invention relates to a temperature switch having a rod-like temperature sensor.

DE-B-25 00 586 discloses a temperature switch whose sensor comprises a metal tube, which serves as the expansion element and which transfers its expansion via an inner rod made from a material with a lower thermal expansion coefficient to the switch. This sensor is provided with a quartz tube engaged over it and which ensures that the sensor does not constitute an electrical bridge of the air gap between the heating resistors and the heated glass ceramic plate. As the quartz tube is radiotransparent it scarcely prevents the transmutation of radiation heat.

DE-U-78 26 549 discloses a regulator for gas cookers, in which a further metal tube is engaged over the sensor tube and is spaced therefrom. This tube is intended to prevent the gas flame from directly striking the sensor.

EP-B-116 861 discloses a temperature switch, which is located on a web of insulating material of the radiant heater in which it is fitted and which partly protects it against radiation, so that a temporary response delay is brought about. This makes it possible to bring the radiant heater to a higher temperature level during the preliminary heating or cooking phase and which is then lowered to a steady state during further operation, which ensures that there is no damage to the glass ceramic plate in continuous operation. Much the same can be gathered from EP-B-150 087, in which the outer tube belonging to the temperature sensor is constructed as a quartz glass tube. The sensor tube is provided with a coating of an infrared reflecting material to ensure that the infrared radiation allowed to pass through the tubular element does not reach the inner rod.

From the earlier dated, but not previously published German patent application P 38 21 496 a temperature sensor is known, whose outer sensor tube, which forms the expansion standard, comprises a material mainly absorbing the radiation from the radiation source and e.g. in the form of a completely sintered ceramic material, preferably cordierite.

Temperature switches with such rod-like differential expansion members as sensors, in which the outer tube belonging to the sensor is made from fused silica can admittedly be made relatively thin and as a result of the good insulating characteristics of the fused silica solve the problem of the breakdown strength between the heating resistors and the hotplate, but are relatively susceptible to breakage. A break or even minor damage at one of the ends has an immediate effect on the switching accuracy and can therefore be prejudicial to the complete means to be monitored. It is difficult to apply with the necessary resistance coatings to the fused silica and can produce within the sensor a type of "greenhouse effect", which has an favorable influence on the control behavior.

It would therefore be desirable to use the regulator construction known from DE-B-25 00 586 with an inner reference standard rod and an outer expansion tube, e.g. of metal. However, with the overengaged fused silica tube according to said specification, the switching amplitudes of the regulator are too limited, so that it switches too often and exceeds the admissible "click rate" prescribed as a result of radio and mains interference. In addition, during the first heating switching off takes place earlier than desired. Thus, during the first heating it is possible to exceed the maximum continuous temperature necessary for protecting the glass ceramic without putting it at risk, so that shorter preliminary heating times can be obtained. Moreover the fused silica tube is relatively expensive and susceptible to breakage.

SUMMARY OF THE INVENTION

An object of the invention is therefore to provide a temperature limiter, which avoids the disadvantages of the prior art and which in the case of a reliable, operationally secure construction ensures a higher switching amplitude and an increased preliminary heating period.

Accorrding to the invention this object is achieved by providing ceramic material for at least partially protecting the temperature sensor against direct external thermal radiation by at least one of means provided by reflection and absorbtion of said outer radiation.

The use of a ceramic material, which in itself has absorption or reflection characteristics and preferably both ensures that the sensor only receives secondary heat in the form of secondary radiation of the outer tube or contact or convection heat transfer. Thus, a delay automatically occurs, which leads to a thermal response delay of the temperature switch. Consequently the regulator can initially "overshoot" the set switch-off temperature, whereas in continuous operation the set temperature is precisely maintained. An increased thermal inertia of the outer tube, which increases the response delay is advantageous for this.

The outer tube can comprise or contain a magnesium silicate-containing ceramic, optionally with a proportion of alumino silicate. A particularly preferred material is steatite, which in the completely sintered state not only has the advantageous reflection and absorption properties, i.e. is scarcely directly radiotransparent, but in dropping tests is less susceptible to breakage than a fused silica tube. In addition, its improved heat conducting properties contribute to an improved regulating or control behavior, particularly in the case that too small or displaced pots are placed over the heating point. In such cases the temperature switch responds earlier than with the fused silica tube, so that it is possible to avoid partial overheating on the glass ceramic. Thus, as a result of the invention not only is an initial switching delay obtained, but also in the particularly critical case of the "displaced pot" there is also an earlier and consequently also more accurate response. These fundamentally contradictory requirements are surprisingly achieved, although the switching hysteresis is much greater than in the prior art constructions.

The temperature switch is particularly intended for radiation heating systems for glass ceramic, whose radiation source at least contains a radiant heater, whose heating resistor operates at temperatures above 1500 K. and which is e.g. in the form of a halogen lamp. These so-called light radiators (radiant lamp heaters) as a result of their intense and relatively shortwave radiation, are to be regulated particularly critically in the sense of a temperature limitation for the glass ceramic plate, particularly if additional conventional heating resistors with much lower glow or incandescence temperatures are used.

BRIEF DESCRIPTION OF THE DRAWINGS

These and other features of the preferred developments of the invention can be gathered from the claims, description and drawings and the individual features can be realized in an embodiment of the invention and in other fields either singly or in the form of subcombinations and can represent advantageous, independently protectable constructions for which protection is hereby claimed. Embodiments of the invention are described hereinafter relative to the drawings, wherein:

FIG. 1 is a plan view of a radiant heating means equipped with a temperature switch.

FIG. 2 is a detail longitudinal section through a sensor portion of the temperature switch.

FIG. 3 is a cross-section through the temperature sensor.

DETAILED DESCRIPTION OF THE PREFERRED EMBODIMENTS

FIG. 1 shows a radiant heater 11, which is positioned below a glass ceramic plate 12 indicated in FIG. 2 and defines thereon a hot point or cooking point. An edge 14 of an insulating support 15, which is located in the flat sheet metal support tray 16, forms the outer boundary of the hot point.

The heating system for the radiant heater 11 is formed by a light radiator 18 and a dark radiator 20. In a quartz glass tube the light radiator 18 contains a high temperature-resistant heating resistor 21, e.g. of tungsten. The quartz glass tube 24 is bent polygonally or substantially circularly and its two terminals 22 pass in closely juxtaposed, parallel manner through the edge 14 and out of the radiant heater and are provided there with line terminals. The correct glow temperature is above 1500 K. and preferably at 2300 K.

The glow temperature of the dark radiator 20 is well below these values. It is a normally helically wound, open wire made from resistance material and which as a result of its lower glow temperature does not require an inert gas atmosphere as is the case with the light radiator. The dark radiator is constructed in the form of a double guided ring, whose terminals 25 extend to the inner and outer turn on the same side of the double bend and on the other side the two turns are connected to one another by a bend or arc 26. A connecting piece 38 for the dark radiator terminals is inserted in the edge of the support tray 16.

A rod-like temperature sensor 27 of a temperature switch 28 projects diametrically over the circular radiant heater and is guided on both sides in the edge 14. The head 40 of the temperature switch 28 is located outside the remaining radiant heater boundary. It contains two switching contacts 41, 42, cf. FIG. 1. One is used for temperature limitation purposes and the other as a signal contact for indicating the hot state of the hot point. At a distance from the underside of the glass ceramic plate 12 and the radiators 18, the temperature switch 27 projects through the dish-shaped interior of the radiant heater. The two radiators 18, 20 forming the radiation source form two substantially concentric rings, whereof the light radiator 18 forms the inner ring.

The temperature sensor 27 of the temperature switch 28 comprises a metallic sensor tube 43 and a rod 44 located within it made from a material with a lower thermal expansion coefficient than the sensor tube 43 and constituted e.g. by a ceramic rod. The sensor tube is fixed in the casing of the switch head 40, while the rod 44 acts directly or indirectly on the switching contact or contacts 41, 42. At the free end of the sensor tube 43, the rod 44 is supported on a not shown adjusting screw inserted there and which is adjustable in a thread of the sensor tube.

The sensor tube 43 is surrounded by an outer tube 45, whose internal diameter is somewhat larger than the external diameter of the sensor tube, so that a gap 50 is formed between the two tubes. The outer tube 45 rests under gravity on the sensor tube, so that the gap 50 is formed in particular in the lower region. The outer tube can be axially guided within the edge 14 if the holes 46 in the latter through which the sensor 27 is passed for positioning and guidance purposes are smaller than the external diameter of the outer tube 45. The outer tube, which is in this case in one piece over the entire radiant heater diameter, should not have a gap in the areas in which are located the open radiation sources, such as the heater coils 20 and through which an electrically conducting bridge to the glass ceramic plate would be formed. At higher temperatures the glass ceramic plate is electrically conductive and therefore the breakdown strength must be dimensioned up to this. Thus, in the represented embodiment, in which the heater coil 20 extends close to the edge 14, the outer tube 45 is guided in a countersunk hole 48 of the edge in the vicinity of the free sensor end, so that the outer tube extends somewhat into the edge and no gap is formed. On the switch head side the outer tube also projects into an enlarged edge bore 49 there and which, in the same way as the bores 46, 48, can be formed as U-shaped recesses open towards the top of the edge. In the vicinity of the switch head, an elastic element 51 in the form of a heat resistant tube, e.g. a silicone-fiber glass insulating tube is drawn over the sensor tube 43. On element 51 is supported and positioned elastically the outer tube 45 in such a way that it is pressed against the shoulder between the bores 46, 48. Thus, the outer tube is elastically guided, so that it is much less susceptible to breakage than if it were freely movable.

The outer tube 45 is made from steatite. This material of group KER 200 according to DIN 40685 (ceramic insulating materials for electrical engineering) has proved particularly advantageous. Steatite is a magnesium silicate-containing product, which is particularly tight and prior to firing can be easily worked by casting, turning, extrusion, moulding, etc., so that it is possible to produce a long, relatively thin-walled tube. In an embodiment the outer tube 45 has an external diameter of 7 mm for a wall thickness of approximately 0.8 mm. After firing the material is mechanically very strong, has a very high electrical breakdown strength and in particular a much higher bending strength compared with fused silica. A particularly advantageous characteristic in this connection is the fact that for a relatively high apparent solid volume has a high specific heat, so that the thermal inertia provided by the tube as a result of its heat storage capacity is high. Particular importance is attached to the fact that it is not transparent and as a result of its usually light color reflects a large proportion of the radiation, while the other part is absorbed and then is only supplied by secondary radiation, heat conduction or convection to the sensor tube 43, which takes place with a certain delay. The thermal conductivity is also higher than for fused silica, so that the outer tube contributes to distributing the heat over the sensor length and therefore in the described situation of a "displaced pot" to an earlier response.

Other materials having similar characteristics are also suitable, e.g. aluminum-magnesium-silicates (group KER 400 according to DIN 40685), where cordierite is a suitable material, although its excellent characteristic, namely the low thermal expansion, is more rarely required. However, the resulting increased thermal shock stability can be important in special cases.

After switching on the radiation sources 18, 20, they heat rapidly, particularly the light radiator 18, and the radiation is directed onto the glass ceramic plate 12, which transmits part of the radiation, but converts a large part thereof. The glass ceramic plate heats considerably and on its underside the critical temperature of approximately 900 to 1000 K. would be relatively rapidly reached at which the glass ceramic would suffer permanet damage, if it were operated for a long period at this temperature. Therefore the temperature limiter is provided, which is set in such a way that, apart from operating a hot indicator, which responds at temperatures of approximately 300 K., it switches off the radiant heaters or reduces the power thereof when the temperature approaches the critical temperature of the glass ceramic plate. The radiation is shielded by the outer tube 45 and is partly absorbed and partly reflected. It is advantageous for the gap 50 of e.g. 0.5 to 0.8 mm between the sensor tube 43 and the outer tube 45 to be mainly formed on the underside where the radiation strikes, so that an insulation gap is formed there. Thus, the heat can only be transmitted by secondary radiation or heat transfer into the gap 50, whilst contact transfer only occurs in the upper portion, where the outer tube rests on the sensor tube. However, by then the heat must be conducted round half the circumference of the outer tube. Consequently there is a considerable response delay allowing the temperature to overshoot on the underside of the glass ceramic by somewhat more than the continuous limitation value, which has proved to be admissible and considerably shortens the preliminary heating times. As a result of the one-sided gap formation and which occurs by gravity when a heating element is positioned below the heated plate, but which in other arrangements can be brought about by other measures, also ensures that due to the better heat transfer from the heated plate, its back radiation occurs to a greater extent.

Under steady state conditions the delay brought about by all factors, such as shielding, thermal mass, etc. has the effect of increasing by almost a power of ten the switching amplitude and therefore the switching intervals can be reduced to an admissible amount. Thus, the switching amplitude can be increased from +/−1.5 K. for a quartz tube to +/−11 K. for a steatite outer tube.

Naturally, the outer tube 45 has the desired effect that the necessary air gap between the glass ceramic conducting at higher temperature and the radiant heaters, particularly the open radiant heaters, is not bridged. This is also important because in the case of a breakage of the glass ceramic and/or an encapsulated radiation source, such as the light radiator 18, no electrically conducting bridge is formed and instead additional security against contact is provided.

We claim:

1. A temperature switch for a radiant heating means having at least one radiation source for emitting radiation, said temperature switch comprising:

at least one switching contact;

at least one temperature sensor comprising temperature responsive bodies including a rod and a temperature sensor surrounding said rod, said rod and said sensor tube having different thermal expansion coefficients, and said sensor tube being made from a conductive material, and an electically insulating outer tube enveloping said sensor tube, wherein said outer tube is formed with a ceramic material for protecting at least one of said temperature responsive bodies against a substantial amount of said radiation source by at least one characteristic provided by a radiation absorbing characteristic and a radiation reflecting characteristic.

2. The temperature switch according to claim 1, wherein said outer tube contains a magnesium silicate-containing ceramic material.

3. The temperature switch according to claim 2, wherein said outer tube contains a portion of an alumino silicate material.

4. The temperature switch according to claim 1, wherein said entire outer tube is made from said ceramic material.

5. The temperature switch according to claim 1, wherein said outer tube increases the thermal response delay response time of the temperature switch.

6. The temperature switch according to claim 1, wherein said outer tube is characterized by an increased thermal inertia and an increased thermal conductivity with respect to fused silica material.

7. The temperature switch according to claim 2, wherein the outer tube is made from steatite.

8. The temperature switch according to claim 1, wherein a gap is provided between said outer tube and said sensor tube.

9. The temperature switch according to claim 1, wherein said outer tube is displaced towards the radiation source with respect to said sensor tube.

10. The temperature switch according to claim 9, wherein said outer tube rests under gravity on said sensor tube.

11. The temperature switch according to claim 1, wherein said outer tube is constructed in one piece over substantially an entire length extension of said temperature sensor.

12. The temperature switch according to claim 1, wherein said radiant source has at least one substantially unprotected radiant heating resistor, said outer tube being constructed in one piece in the vicinity of said radiant heating resistor.

13. The temperature switch according to claim 1, wherein said outer tube is axially guided by an insulating edge of said radiant heating means.

14. The temperature switch according to claim 1, wherein said outer tube axially adjusted by at least one countersunk hole.

15. The temperature switch according to claim 1, wherein said outer tube is axially elastically guided towards a switch head containing said at least one switching contact by an elastic element.

16. The temperature switch according to claim 15, wherein said elastic element is a heat-resistant insulating tube surrounding said sensor tube.

17. The temperature switch according to claim 1, wherein said rod is made from ceramic material and said sensor tube is made from metal having a higher thermal expansion coefficient than said ceramic material.

18. The temperature switch according to claim 1, wherein the radiant heating means is constructed for heating via a glass ceramic plate, said at least one radiation source containing at least one radiant heater having a heating resistor operating at temperatures above 1500 K.

19. The temperature switch according to claim 18, wherein said heating resistor is an encapsuled lamp containing a protection gas.

20. A temperature sensor for receiving thermally effective radiation from a radiating means, said temperature sensor comprising:

at least one temperature responsive sensing body;

a shield member separate from said at least one sensing body and at least partly shielding said at least one sensing body from said radiation, wherein said shield member is formed with a ceramic material for protecting said at least one sensing body against a substantial amount of the radiation by at least one characteristic provided by a radiation absorbing characteristic and a radiation reflecting characteristic.

* * * * *